United States Patent [19]

Reusser et al.

[11] Patent Number: 4,520,222

[45] Date of Patent: May 28, 1985

[54] POLYMERIZATION CATALYST AND DEODORIZING AGENT AND PROCESS OF USE

[75] Inventors: Robert E. Reusser; Joseph R. Kenton; Elizabeth A. Todd, all of Bartlesville, Okla.

[73] Assignee: Phillips Petroleum Company, Bartlesville, Okla.

[21] Appl. No.: 518,857

[22] Filed: Aug. 1, 1983

Related U.S. Application Data

[62] Division of Ser. No. 448,558, Dec. 10, 1982, Pat. No. 4,425,226.

[51] Int. Cl.[3] ..... C07C 2/02

[52] U.S. Cl. ..... 585/526; 502/83; 502/250; 585/527; 585/529; 585/530

[58] Field of Search ..... 585/526, 527, 529, 530; 502/83, 250

[56] References Cited

U.S. PATENT DOCUMENTS

| | | | |
|---|---|---|---|
| 2,116,151 | 5/1938 | Ipatieff et al. | 585/529 |
| 2,148,378 | 2/1939 | Malishev | 585/527 |
| 2,245,143 | 6/1941 | Gerhold | 585/529 |
| 2,289,778 | 7/1942 | Herold | 585/526 |
| 2,293,353 | 8/1942 | Moravec et al. | 585/526 |
| 2,314,458 | 3/1943 | Stahly et al. | 585/526 |
| 2,434,833 | 1/1948 | Ciapetta et al. | 585/526 |
| 2,468,507 | 4/1949 | Moore | 585/526 |
| 3,586,729 | 6/1971 | Juguin et al. | 585/529 |

FOREIGN PATENT DOCUMENTS

| | | | |
|---|---|---|---|
| 511556 | 8/1939 | United Kingdom | 585/526 |

*Primary Examiner*—Delbert E. Gantz
*Assistant Examiner*—Cynthia A. Prezlock

[57] ABSTRACT

Calcium silicate treated with an acid can be used as a polymerization catalyst or as a deodorizing agent. The acid is sulfuric acid, phosphoric acid or nitric acid.

6 Claims, No Drawings

POLYMERIZATION CATALYST AND DEODORIZING AGENT AND PROCESS OF USE

This application is a divisional application of application Ser. No. 448,558 filed Dec. 10, 1982, now U.S. Pat. No. 4,425,226.

In one aspect this invention relates to the deodorization of a hydrocarbon feedstock.

In another aspect this invention relates to the polymerization of unsaturated hydrocarbons.

BRIEF SUMMARY OF THE INVENTION

The composition of matter used in the practice of this invention is calcium silicate treated with an acid. The acid is sulfuric acid, phosphoric acid, nitric acid, or a combination thereof.

In one embodiment of this invention the above-described composition is employed as a deodorizing agent in a process for the deodorization of a paraffinic hydrocarbon-containing feedstock.

In another embodiment of this invention the above-described composition is employed as a catalyst for the polymerization of olefins.

This invention is further defined by, and other aspects of this invention are identified in, the disclosure and claims which follow.

THE COMPOSITION OF MATTER

The composition of matter used in the practice of this invention is calcium silicate treated with at least one of sulfuric acid, phosphoric acid and nitric acid. Mixtures of the acids are also within the scope of this invention. Calcium silicate is capable of absorbing relatively large amounts of such acids. In fact, it has been found that calcium silicate can absorb more than 4 times its own weight in, for example, sulfuric acid.

Sulfuric acid is commonly represented by the chemical formula $H_2SO_4$. Commercially-available sulfuric acid is well suited for use in the practice of this invention. For more detailed information relating to sulfuric acid the reader is referred to the Kirk-Othmer Encyclopedia of Chemical Technology, Second Edition, Volume 19, pages 441–482. Sulfuric acid is the preferred acid of this invention because of the good deodorization results obtained (see Examples I and II).

The phosphoric acids within the scope of this invention include the linear acids of the general formula $H_{n+2}P_nO_{3n+1}$ where n is a positive integer greater than 0. Examples of such phosphoric acids are set forth below:

Orthophosphoric acid, $H_3PO_4$

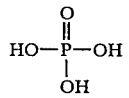

Pyrophosphoric acid, $H_4P_2O_7$

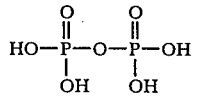

Triphosphoric acid, $H_5P_3O_{10}$

-continued

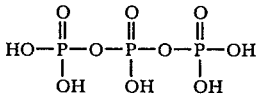

Tetraphosphoric acid, $H_6P_4O_{13}$

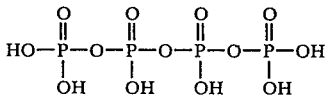

Other phosphoric acids within the scope of this invention include by way of example:

hemihydrate phosphoric acid, $H_3PO_4 \cdot \frac{1}{2}H_2O$
trimetaphosphoric acid, $H_3P_3O_9$
tetrametaphosphoric acid, $H_4P_4O_{12}$
sodium salt phosphoric acid, $NaH_2PO_4 \cdot H_3PO_4$
potassium salt phosphoric acid, $KH_2PO_4 \cdot H_3PO_4$
calcium salt phosphoric acid, $Ca(H_2PO_4)_2$
ammonium salt phosphoric acid, $NH_4H(H_2PO_4)_2$
aluminum salt phosphoric acid, $Al(H_2PO_4)_3$
metaphosphoric acid, $HPO_3$ Mixtures of various phosphoric acids are also included within the scope of this invention. For more detailed information concerning phosphoric acids the reader is referred to the Kirk-Othmer Encyclopedia of Chemistry, Third Edition, Volume 17, pages 426–472.

Nitric acid is commonly represented by the chemical formula $HNO_3$. Commercially-available nitric acid is well suited for use in the practice of this invention. For more detailed information relating to nitric acid the reader is referred to the Kirk-Othmer Encyclopedia of Technology, Third Edition, Volume 15, pages 853–871.

The acids of this invention, i.e. sulfuric acid, phosphoric acid and nitric acid are commercially available to those desiring to practice this invention. We recommend that the acids employed in making the composition of this invention be in liquid form. The acids are typically in liquid form and, as liquids, absorption into the calcium silicate is a simple process. It is further recommended that the acids be concentrated acids. In other words, as little water as possible should be used since water should usually be removed before using the composition as a deodorizing agent. The composition can be heated to drive off volatiles such as water.

The preferred calcium silicate is calcium metasilicate ($CaSiO_3$). Calcium metasilicate is preferred because of its good absorption properties. Wollastonite is a natural calcium silicate that is included within the scope of this invention. A review of synthetic inorganic silicates can be found in the Kirk-Othmer Encyclopedia of Chemical Technology, Second Edition, Volume 18, pages 134–165. A review of silicate minerals can be found in The New Encyclopedia Britannica, Macropaedia Volume 16, pages 756–764.

The composition of this invention is made by treating calcium silicate with the acid. This requires little more than bringing the acid and calcium silicate in contact with each other.

The composition, as broadly defined, is not limited to any particular weight percentage range with respect to the acid content of the composition. The essence of this invention, as broadly defined, is the combination of calcium silicate and acid.

In an embodiment of this invention, acid is absorbed by the calcium silicate and the weight percentage of absorbed acid is greater than about 20 weight percent based upon the total amount of calcium silicate and absorbed acid. It is preferred that this weight percentage of absorbed acid be greater than about 70 weight percent since a higher content of acid will improve the deodorization and catalytic utility of the composition.

We recommend that the absorbed acid content of the composition be kept below about 90 weight percent based upon the total amount of calcium silicate and absorbed acid. We prefer that the acid content be kept below about 85 weight percent to avoid oversaturating the calcium silicate.

It is preferred that the absorbed acid content be maintained sufficiently low such that the composition (i.e. calcium silicate and absorbed acid) is dry or substantially dry. It is also preferred that the dry or substantially dry composition be in the form of a powder. A dry or substantially dry powder is preferred because of ease of handling and more effective operation in deodorization and polymerization processes. The calcium silicates ability to absorb relatively large amounts of liquid acid provides a significant advantage in that it enables use of the normally liquid acid in a dry powdery form.

In one embodiment of this invention the acid-treated calcium silicate is heated at a temperature of at least about 100° C. and optionally contacted with nitrogen ($N_2$) gas. Although this embodiment is not limited thereto it is contemplated that, generally, the acid-treated calcium silicate will be heated at about 150° C. to about 250° C. for about ½ to about 20 hours. The nitrogen contact can be accomplished by allowing nitrogen gas to flow into contact with the acid-treated calcium silicate. The nitrogen flow is useful for activation and water removal purposes.

OLEFIN POLYMERIZATION

The above-described composition of matter can be employed as an olefin polymerization catalyst. The polymerization process of this invention entails bringing an olefin-containing feed into contact with the catalyst under conditions sufficient to effect polymerization of at least a portion of the olefin content of the feed. The term polymerization as used in this disclosure and the appended claims is intended to be broadly construed to include dimerization, trimerization, oligomerization and the like.

The olefin can be any monoolefin, diolefin, etc. Examples include, but are not limited to, ethylene, propylene, 1-butene, isobutylene, 1-pentene, 3-methyl-1-butene, 1,3-butadiene, 4-methyl-1-pentene, etc.

Conventional olefin polymerization methods and apparatus can be readily adapted by those of skill in the art to the present invention. For more information the reader is referred to the Kirk-Othmer Encyclopedia of Chemical Technology, Third Edition, Volume 16, pages 385–499 and generally to the Encyclopedia of Polymer Science and Technology. The novelty of this inventive polymerization process resides in the choice of polymerization catalyst and not in any particular manner or apparatus of polymerization.

The polymerization can be carried out, for example, in a batch reactor, a continuous-flow stirred-tank reactor, a tubular reactor or in reactors that are variations or hybrids of the above. In one embodiment of this invention an olefin-containing feed is continuously passed into a tubular reactor having a bed of the catalyst positioned therein. In another embodiment of this invention gaseous olefin is bubbled into a vessel containing the catalyst and a solvent.

Although this invention is not limited to any particular range of temperature or pressure it is contemplated that polymerization temperatures will generally be below about 50° C. and that polymerization pressures will generally range from about 0 to about 100 atmospheres. These and other parameters are subject to wide variation depending upon the particular apparatus employed, the olefin feed, the degree of polymerization desired, etc.

The catalyst can be regenerated or reactivated after use by heating the catalyst at a temperature of at least about 100° C. and contacting the catalyst with nitrogen ($N_2$) gas.

DEODORIZATION

The aerosol industry has successfully employed fluorocarbons as propellants in aerosol containers. Fluorocarbons are well suited to this purpose since they are usually non-flammable, non-toxic and odorless. Use of fluorocarbons as propellants has, however, diminished because of the adverse environmental impact they are believed to have on the ozone layer of our atmosphere. As a consequence it has become desirable to find substitutes for the fluorocarbon propellants. Saturated hydrocarbons have been used to this end. Best suited are the low boiling paraffinic hydrocarbons such as, for example, propane, isobutane, n-butane, and pentane.

One disadvantage associated with the use of saturated hydrocarbons is the presence of impurities that impart undesirable odors. Although these impurities are usually present only in very small amounts their odorous presence is typically very perceptible. These odor-causing impurities must be removed before the hydrocarbon is used as a propellant. The odor-causing impurities include sulfides, mercaptans, olefins and oxygenated olefins. Removal of olefin impurities, for example, can be a formidable task since quantities as low as 10 parts per million (ppm) (0.001 wt %) are known to cause an unacceptable odor.

This invention provides a process for the deodorization of such hydrocarbon propellants. More broadly, the process is applicable to the deodorization of paraffinic hydrocarbon feedstocks containing odor-causing impurities.

In accordance with this aspect of the invention the previously described composition of matter is used as a deodorizing agent. The process is carried out by bringing an impurity-containing paraffinic hydrocarbon feedstock into contact with the deodorizing agent.

The feedstock to be purified in accordance with this process can be any paraffinic hydrocarbon (i.e. alkane) or mixture of paraffinic hydrocarbons. Examples include methane, ethane, propane, n-butane, isobutane, any of the pentanes and other compounds (including all isomers) of the general formula $C_nH_{2n+2}$, where n is an integer signifying the number of carbon atoms. This invention is especially well suited for paraffinic hydrocarbons useful as propellants represented by the above formula where n is less than about 6.

Odor-causing impurities in the feedstock can include, for example, olefins (i.e. alkenes), sulfides, mercaptans and numerous other sulfur-based compounds and oxygenated compounds. Olefins are of particular concern and this invention, though not limited thereto, is especially well suited for the deodorization of olefin-containing feedstocks. Of most concern are the low molecular weight (i.e. molecular weight less than about 84), odor-causing olefins. Examples of odor-causing olefins include propylene, isobutylene, n-butenes, pentenes and the like. It is contemplated that in a typical feedstock the weight ratio of total paraffinic hydrocarbon to total olefin will be greater than about 4 to 1 and in many cases greater than about 20 to 1. This invention, however, is not limited to the above and is applicable to other feedstocks including those having a higher olefin content or no olefin at all. Paraffinic hydrocarbon-containing feedstocks useful as propellants and having a total low molecular weight olefin content of less than about 1000 parts by weight per million parts by weight of total paraffinic hydrocarbon are especially well suited for the practice of this invention.

The feedstock can contain, in addition to paraffinic hydrocarbons and odor-causing impurities, other components which are neither paraffinic hydrocarbons nor odor-causing. Typically, but not necessarily, the content of such other compounds will be low or non-existent.

The process can be carried out in any manner and with any apparatus capable of bringing the feedstock into contact with the deodorizing agent. Persons of skill in the relevant art possess sufficient knowledge of reactor technology to practice this aspect of the invention. Information on reactor technology can be found in the Kirk-Othmer Encyclopedia of Technology, Volume 19, pages 880–913 as well as in numerous other books and references.

A vertical tubular reactor is well suited to the purposes of this aspect of the invention. The feedstock can be passed upwards or downwards, as desired, through deodorizing agent positioned in the vertical reactor. Flow through the reactor can be continuous and at steady state if desired. The rate at which feedstock is fed into the reactor will depend in part on the type of paraffinic hydrocarbon being deodorized and the type and amount of odor-causing impurities present in the feedstock. A typical feed rate is about 5 liquid volumes of feedstock per volume of deodorizing agent bed per hour or a Liquid Hourly Space Velocity (LHSV) of 5. Other typical rates include a Weight Hourly Space Velocity (WHSV) of 3.86 and a Gas Hourly Space Velocity (GHSV) of 1230. The following flow rates are considered to be within the scope of this invention (but this invention is not limited thereto):

0.5 to 200 LHSV
0.3 to 150 WHSV
100 to 50,000 GHSV

The process described herein can be run at ambient room temperature or at elevated temperatures if desired. However, temperatures above about 150° C. are not recommended because of acid volatilization, acid decomposition and carbon production on the deodorizing agent.

The process described herein can be carried out in either liquid or vapor phase but liquid phase is preferred. To conduct the process in the liquid phase it may be necessary to operate under a slight pressure particularly with the lower boiling paraffinic hydrocarbons. For example, when propane is being treated a pressure of 130–150 psig (0.896–1.034 MPa) may be necessary to maintain a liquid phase. When isobutane is the feedstock, a pressure of about 40–60 psig (0.27–0.41 MPa) may be necessary to maintain a liquid phase.

After contact with the deodorizing agent the product (i.e. the treated feedstock) can be passed to a distillation column or some other fractionation or separation means to recover a purer paraffinic hydrocarbon. It is believed that olefins are polymerized (e.g. dimerized, trimerized, oligomerized, etc.) by the deodorizing agent. This increase in molecular weight facilitates separation (as by distillation for example) from the paraffinic hydrocarbon.

The deodorization agent can be regenerated or reactivated by heating it to a temperature of at least about 100° C. and contacting it with nitrogen ($N_2$) gas.

The following examples are given to provide a better and more complete disclosure of this invention.

EXAMPLE I

This example shows how readily olefin impurities are removed from paraffinic hydrocarbon-containing feedstocks.

The deodorizing agent used in this invention was prepared by treating 10.3 grams of a synthetic hydrous calcium silicate (Micro-Cel® from Johns-Manville Products Corporation of Denver, Colo.) with 40.5 grams of concentrated sulfuric acid. The powdered mixture was mechanically tumbled for 2 hours. About 45.8 grams (75 milliliters) of the calcium silicate-sulfuric acid powder was placed into a 63.5 cm (25 inch)×1.27 cm (0.5 inch) stainless steel tube or column. The tube was heated for 4 hrs. at 204° C. (400° F.). During this heating period a slow stream of nitrogen was passed downwardly through the deodorizing agent for drying and/or activation purposes. After cooling to ambient room temperature, a paraffinic hydrocarbon-containing feedstock containing mostly isobutane (i.e.>96 wt %) and a small, but odorous, amount of olefin impurities (i.e. 0.0186 wt % or 186 ppm), was passed upwardly through the column at a rate of about 5 LHSV using a column pressure of 50 psig (0.344 MPa). Prior to introduction of the feedstock into the column the feedstock had been passed through a column of 13X molecular sieves to remove water.

The composition of the feedstock was determined by gas-liquid chromatography (GLC) using a 914.4 cm (30 ft.)×0.635 cm (0.25 in.) column packed with 19 wt. % bis[2-(2-methyl-ethoxy)ethyl]ether plus 1 wt. % squalene on 45–60 mesh Chromosorb P-NAW (from Johns-Manville Products Corporation of Denver, Colo.). The chromatograph column was operated at ambient room temperature using a 30 cc/min. helium flow. The analysis shown in Table I is typical for an olefin-containing isobutane feedstock before treatment.

TABLE I

Analysis of a Typical Isobutane Feedstock Before Olefin Removal

| Component | Wt. % by GLC | |
|---|---|---|
| ethane | 0.006 | |
| propane | 0.550 | |
| isobutane | 96.820 | |
| n-butane | 2.550 | |
| isobutylene | 0.0156 | |
| trans-butene-2 | 0.002 | 186 ppm |
| cis-butene-2 | <0.001 | |

As the hydrocarbon passed through the column packed with the calcium silicate-sulfuric acid, GLC analyses were periodically made to determine the olefin content. Initially no olefin was detected in the treated hydrocarbon. Eventually a trace of olefin began to appear but the level was so low that the exact amount could not be determined. A level of 10 ppm (0.001 wt. %) olefin was considered to be the maximum acceptable level for an odorless hydrocarbon. The run was continued until 1375 volumes of feed per volume of deodorizing agent had passed through the column. The run was discontinued even though the olefin content was still well below the maximum tolerable level of 0.001 wt. %.

EXAMPLE II

This example shows how the calcium silicate-sulfuric acid deodorizing agent of the invention operates when another paraffinic hydrocarbon feedstock having a higher olefin content (i.e. 0.0563 wt. %, 563 ppm) is used. This example also illustrates how readily the deodorizing agent can be regenerated for further use. The run described in Example I was repeated except 22.6 grams (40 milliliters) of the calcium silicate-sulfuric acid powder was used. The composition of the feedstock is shown in Table II.

TABLE II

Analysis of Olefin Isobutane Feedstock Before Olefin Removal

| Component | Wt. % by GLC |
|---|---|
| ethane | <0.005 |
| propane | 1.330 |
| propylene | 0.0044 |
| isobutane | 98.31 |
| n-butane | 0.266 |
| isobutylene | 0.0490 |
| trans-butene-2 | 0.0024 |
| cis-butene-2 | <0.0005 |

The column was operated at ambient room temperature, 50 psig (0.344 MPa) and a feed rate of 5 LHSV. The deodorizing agent successfully removed the olefins shown in Table II until the ratio of total feed volume to deodorizing agent volume reached 1809 at which time a large peak of isobutylene began to appear. The amount of isobutylene was then greater than the maximum acceptable level of b 0.0010 wt. % (10 ppm). At this point the feed was interrupted and the deodorizing agent bed regenerated by passing downwardly a slow stream of nitrogen at 177° C. (350° F.) for 6 hours through the bed. After regeneration treatment of the feedstock resumed (i.e. untreated feedstock was continuously introduced into the column). When the level of isobutylene in the treated product again exceeded 0.001 wt. % feedstock introduction was halted. At this point the volume of feed introduced after regeneration was equal to 915 volumes of the deodorizing agent bed. The deodorizing agent was again regenerated this time at 232° C. (450° F.)). After this second regeneration the continuous introduction of untreated feedstock resumed. No isobutylene or other olefin from the feedstock was detected even after 2400 volumes of feedstock had passed through the column after the second regeneration. This example shows that a high feedstock volume/deodorizing agent bed volume ratio can be obtained by using calcium silicate treated with sulfuric acid and also that this deodorizing agent can be satisfactorily regenerated.

EXAMPLE III

In this example an acid clay is employed as the deodorizing agent. The procedure described in Example I was repeated using an isobutane feedstock having 0.0169 wt. % (169 ppm) isobutylene and, as the deodorizing agent, sulfuric acid-treated montmorillonite subbentonite clay having an acidity value of 12–20 mg. KOH/gram sample (Filtrol ®24-Filtrol Corporation). As were the feedstocks of Examples I and II, the isobutane feedstock was passed through a column of mol sieve to remove any traces of water prior to the deodorization treatment. Feedstock was continuously introduced into the column until the olefin content of the product effluent increased above 0.0010 wt. % (10 ppm). The volume of feed per volume of deodorizing agent in the bed was at this point 534. This value is significantly lower than those obtained in the inventive runs in Examples I and II.

EXAMPLE IV

In this example a sulfuric acid-treated clay was again employed as the deodorizing agent. The procedure described in Example III was repeated except the mol sieve drying step was omitted. Although the step is not essential, the run does demonstrate the advantage of using a mol sieve drying step, namely an increased feedstock volume to deodorizing agent bed volume value. The volume of feedstock that passed through the column before the olefin content of the product increased above 0.001 wt % was equal to about 322 volumes of deodorizing agent bed.

EXAMPLE V

This example illustrates the effect of water on the volume of feed/deodorizing agent bed volume value. The procedure described in Example IV was repeated except 200 ppm (0.020 wt. %) water was intentionally added to the isobutane feedstock. The volume of feed/deodorizing agent bed volume value was found to be 140.

EXAMPLE VI

This example shows that mol sieve, 13X, does not remove any significant amount of olefin. A typical isobutane feedstock was passed through a column of 13X mol sieve at ambient room temperature and at less than 100 psig (0.689 MPa) pressure. The results shown in Table III indicate mol sieve 13X has no effect on the olefin present.

TABLE III

Treatment of an Olefin-Containing Isobutane Feedstock With 13X Mol Sieve

| Component | Wt. % by GLC | |
|---|---|---|
| | Before Treatment | After Treatment |
| ethane | <0.001 | <0.001 |
| ethylene | <0.001 | <0.001 |
| carbon dioxide | 0.008 | <0.001 |
| propane | 0.173 | 0.122 |
| propylene | 0.0002 | <0.001 |
| isobutane | 96.560 | 96.336 |
| n-butane | 3.229 | 3.537 |
| isobutylene | 0.026 | 0.0230 |
| 1-butene | | |
| trans 2-butene | 0.002 | 0.004 |
| cis 2-butene | <0.001 | <0.002 |
| isopentane | 0.002 | 0.002 |
| total sulfur | 0.0001 | 0.00001 |

SUMMARY

The results herein disclosed are summarized in Table IV. These results show that mol sieve has a beneficial effect due probably to its ability to remove water before olefin-removal but the mol sieve itself does not significantly remove olefins. Water is detrimental and should be removed before the olefin removal step. Of most importance is that a calcium silicate-sulfuric acid deodorizing agent can be successfully regenerated and has a longer activity cycle than an acid-treated montmorillonite clay.

TABLE IV

Summary

| Example | Deodorizing Agent | Volume of Feed/ Deodorizing Agent Bed Volume |
|---|---|---|
| I | Micro-Cel/$H_2SO_4$ | 1375+ |
| II | Micro-Cel/$H_2SO_4$ | 1809 |
| | Micro-Cel/$H_2SO_4$, first regeneration | 915 |
| | Micro-Cel/$H_2SO_4$, second regeneration | 2400+ |
| III | $H_2SO_4$ treated montmorillonite clay (Filtrol 24) | 534 |
| IV | $H_2SO_4$ treated montmorillonite (Filtrol 24) -no mol sieve pre-treatment | 322 |
| V | $H_2SO_4$ treated montmorillonite clay (Filtrol 24) plus 200 ppm (0.020 wt. %) $H_2O$ | 140 |
| VI | Mol Sieve 13X | 0[a] |

[a]Catalyst had no effect on olefin removal.

We claim:

1. A polymerization process comprising bringing an olefin-containing feed into contact with a catalyst under conditions sufficient to effect polymerization of at least a portion of the olefin content of the feed; wherein said catalyst comprises calcium silicate treated with at least one acid; wherein the treated calcium silicate is heated to a temperature of at least about 100° C. and contacted with nitrogen gas; and wherein said at least one acid is selected from sulfuric acid, phosphoric acid and nitric acid.

2. A process in accordance with claim 1 wherein said acid is sulfuric acid.

3. A process in accordance with claim 1 wherein said acid is orthophosphoric acid.

4. A process in accordance with claim 1 wherein said acid is nitric acid.

5. A polymerization process comprising bringing an olefin-containing feed into contact with a catalyst under conditions sufficient to effect polymerization of at least a portion of the olefin content of the feed; wherein said catalyst comprises calcium silicate treated with at least one acid; wherein said calcium silicate is treated with about 20 to about 90 weight percent of the acid based upon the total amount of calcium silicate and acid; and wherein said at least one acid is selected from sulfuric acid, phosphoric acid and nitric acid.

6. A process in accordance with claim 5 wherein said calcium silicate is treated with about 70 to about 85 weight percent of the acid based upon the total amount of calcium silicate and acid.

* * * * *